US008051776B1

(12) United States Patent
Bailey

(10) Patent No.: US 8,051,776 B1
(45) Date of Patent: Nov. 8, 2011

(54) SELF-CLEANING CARTRIDGE ACTUATED AND PROPELLANT ACTUATED DEVICES

(75) Inventor: Robert A. Bailey, Avon, IN (US)

(73) Assignee: Raytheon Company, Waltham, MA (US)

( * ) Notice: Subject to any disclaimer, the term of this patent is extended or adjusted under 35 U.S.C. 154(b) by 213 days.

(21) Appl. No.: 12/355,322

(22) Filed: Jan. 16, 2009

Related U.S. Application Data

(60) Provisional application No. 61/022,105, filed on Jan. 18, 2008.

(51) Int. Cl.
*F42B 5/24* (2006.01)
*C06D 5/00* (2006.01)

(52) U.S. Cl. ..... 102/442; 102/529; 102/531

(58) Field of Classification Search ..... 102/442, 102/529, 531
See application file for complete search history.

(56) References Cited

U.S. PATENT DOCUMENTS

| | | | | |
|---|---|---|---|---|
| 3,529,548 | A * | 9/1970 | Heinz et al. | 102/531 |
| 4,226,186 | A * | 10/1980 | Peck | 102/464 |
| 4,283,987 | A | 8/1981 | Stichling et al. | |
| 4,635,443 | A * | 1/1987 | Pino | 60/628 |
| 5,233,128 | A | 8/1993 | Lai | |
| 5,341,744 | A | 8/1994 | Shi | |
| 5,777,258 | A | 7/1998 | Soon | |
| 6,321,968 | B1 | 11/2001 | Remerowski | |
| 7,131,381 | B1 | 11/2006 | Nafziger | |

* cited by examiner

*Primary Examiner* — James Bergin
(74) *Attorney, Agent, or Firm* — Baker Botts L.L.P.

(57) ABSTRACT

In accordance with one embodiment of the present disclosure, a method includes driving a piston by mechanically harnessing an explosion of energetic material contained in a cartridge. The method further includes releasing cleanser contained in the cartridge in response to the explosion of the energetic material.

12 Claims, 2 Drawing Sheets

SELF-CLEANING CARTRIDGE ACTUATED AND PROPELLANT ACTUATED DEVICES

RELATED APPLICATION

This application claims benefit under 35 U.S.C. §119(e) of U.S. Provisional Application Ser. No. 61/022,105, entitled "SELF-CLEANING CARTRIDGE ACTUATED AND PROPELLANT ACTUATED DEVICES" filed Jan. 18, 2008.

TECHNICAL FIELD

This disclosure relates in general to cartridge actuated and propellant actuated devices, and more particularly to self-cleaning cartridge actuated and propellant actuated devices.

BACKGROUND

Cartridge Actuated Devices (CADs) and Propellant Actuated Devices (PADs) are typically self-contained energy sources that are used to do mechanical work. In operation, some such devices may release precise explosive or propellant energy to perform controlled work functions in a variety of military and private industry applications. For example, PADs include such devices as catapults, rocket catapults, and rocket motors which are used in military aircrew escape systems. These devices, in conjunction with various CADs and other life-support equipment, provide the capability to eject aircrew safely from disabled aircraft. Non-aircraft applications have included emergency systems for deep diving submersibles and submarines, propulsion units for mine field markers, release mechanisms for allowing separation of missile stages, timing systems for hand grenade fuses, inflation systems for marking locations of buoys, and recovery systems for reentry space vehicles. In the private sector many of the proposed air bag approaches to passive driver restraint systems are CAD's because of the quick response required and space/weight restrictions. In addition, some such devices are used to pressurize emergency fire suppression systems. The performance and maintenance of some conventional CADs and PADs, however, are limited for a variety of reasons.

SUMMARY

In accordance with one embodiment of the present disclosure, a method includes driving a piston by mechanically harnessing an explosion of energetic material contained in a cartridge. The method further includes releasing cleanser contained in the cartridge in response to the explosion of the energetic material.

Technical advantages of certain embodiments of the present disclosure include a self-cleaning CAD or PAD that provide enhanced performance and reliability while minimizing maintenance. Some embodiments may clean residue left behind by the use of a previous CAD. In addition, some embodiments may cool down the combustion and slow the pressure rise resulting from the CAD explosion, thereby stretching and smoothing out the mechanical response while mitigating the risk of sudden pressure spikes. Some embodiments provide a self-lubricating CAD or PAD.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

Figure 1:
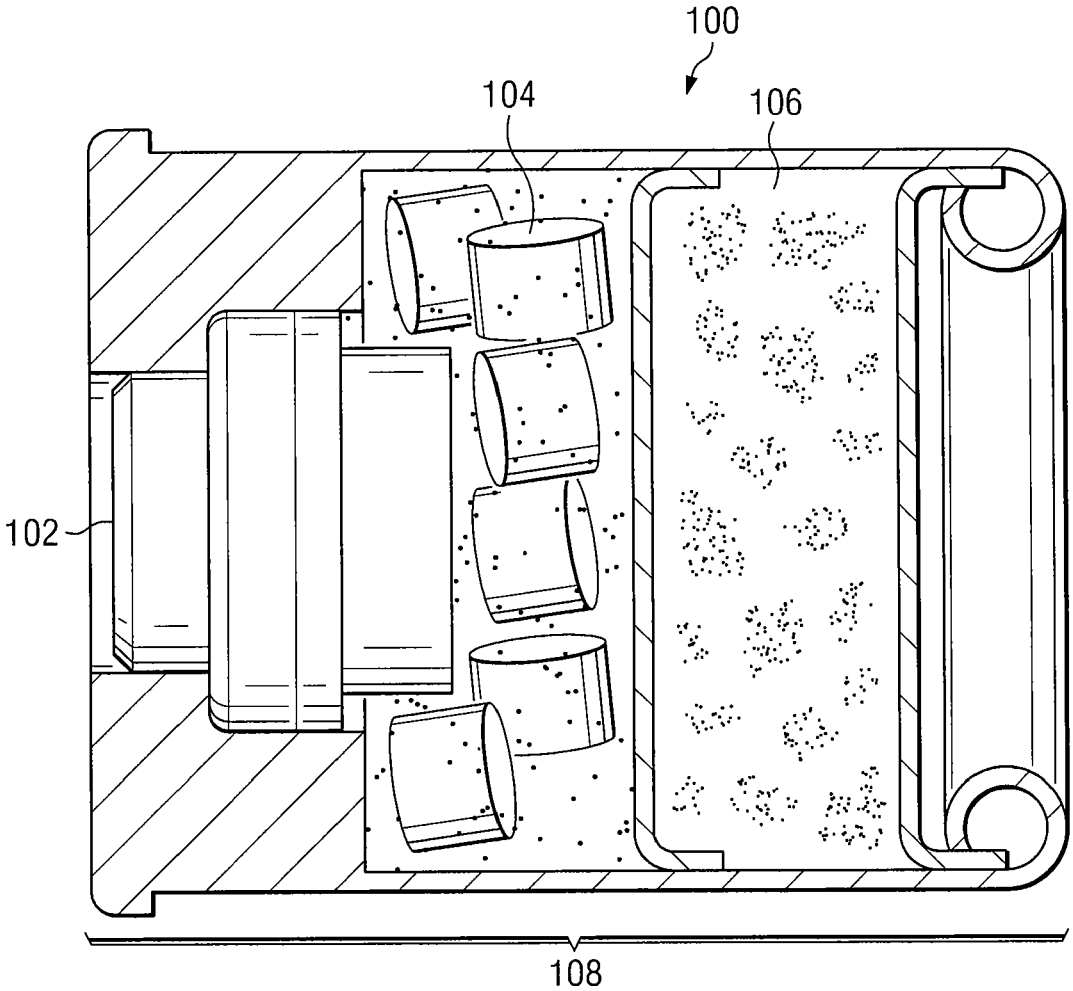
FIG. 1 is a cross-sectional view of a portion of a Cartridge Actuated Device (CAD) according to one embodiment.
Figure 2:
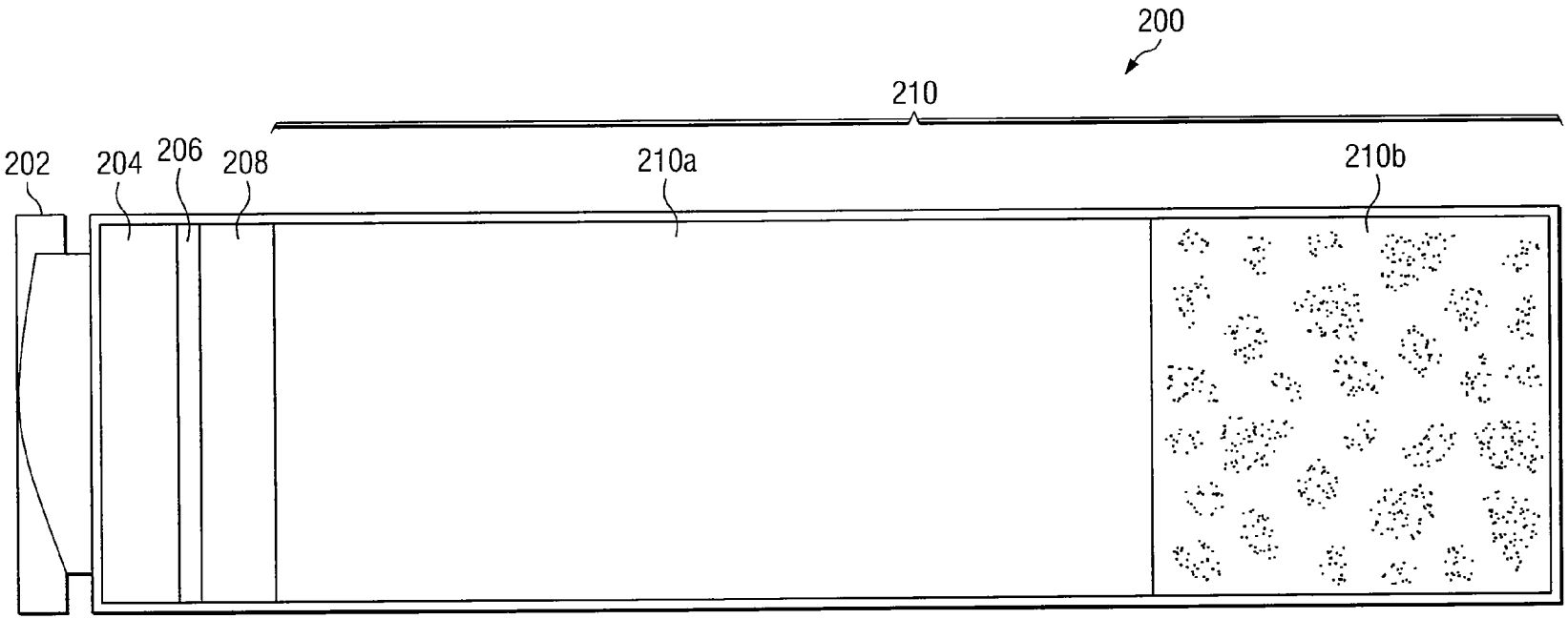
FIG. 2 is a cross-section view of a portion of gun cleaning cartridge according to one embodiment of the present disclosure.

The example embodiments of the present disclosure are best understood by referring to FIGS. 1 and 2 of the drawings, like numerals being used for like and corresponding parts of the various drawings.

FIG. 1 is a cross-sectional view of a portion of a Cartridge Actuated Device (CAD) 100 according to one embodiment. In various embodiments, CAD 100 may function as one or more components of a system. In this example, CAD 100 generally includes an initiator 102, energetic material 104, and cleaning module 106, all housed within a cartridge 108. In operation, initiator 102 may initiate the release of explosive or propellant energy by energetic material 104, which may be mechanically harnessed to perform controlled work functions. The precise explosive or propellant energy released by energetic material 104 may also effect the release of the contents of cleaning module 106, thereby generally enhancing performance and reliability of the system using CAD 100, as explained by example further below.

Initiator 102 generally refers to any device, mechanism, or system capable of effecting the release of energy stored within energetic material 104. The initiation provided by initiator 102 may be in the form of electrical energy (e.g., a particular voltage level), mechanical energy, optical energy (e.g., involving a laser, fiber optics, etc.), pressure (e.g., ballistic hot gas, a pneumatic hose, etc.), combustion energy (e.g., conventional primary explosive and boost charge, an exploding foil initiator, an explosive cord, fuel, etc.), any combination of the proceeding, or any other suitable form. In a particular embodiment, for example, initiator 102 may include a firing pin. In this example, however, initiator 102 includes conductive material capable of heating up in response to an applied voltage (e.g., 28 volts), thereby causing a sensitive primary explosive in initiator 102 to explode. The explosion of initiator 102 triggers the release of energy stored within energetic material 104.

Energetic material 104 generally refers to any suitable material(s) capable of releasing precise explosive or propellant energy. For example, energetic material 104 may include red dot powder, black powder, smokeless powder, hexanitrostilbene (HNS), bistetrazolylaminotetrazine (BTATz), high Nitrogen energetics, a combustible plastic, gel or liquid, any suitable combination of the preceding, or any other suitable material capable of releasing precise explosive or propellant energy. In this example, energetic material 104 includes a tight cluster of compressed pellets with gaps filled in by powder, as illustrated in FIG. 1. In some embodiments, energetic material 104 generates residual byproducts when actuated. For example, the explosive release of some energetic material 104 may generate carbon soot that might inhibit performance and reliability of a system using CAD 100, or otherwise complicate maintenance of such a system. In some such embodiments, cleaning module 106 may be placed in close proximity to energetic material 104 so as to minimize the undesired effects of such byproducts.

Cleaning module 106 generally refers to any material(s) capable of mitigating one or more effects resulting from the release of energy stored within energetic material 104. For example, cleaning module 106 may include water, detergent, light oil, padding or wadding, any combination of the proceeding, or any other material capable of mitigating the undesired effects resulting from the release of energy stored within energetic material 104. The material within cleaning module 106 may be in any suitable form, including, for example, solid, liquid, or gel. In this example, cleaning module 106 includes a separately encapsulated detergent placed in close proximity to energetic material 104. In this manner, the energy release of energetic material 106 may vaporize and spread the detergent in a manner that benefits a system using CAD 100, as explained by example further below. Although FIG. 1 illustrates cleaning module 106 housed within cartridge 108, cleaning module 106 may alternatively be located outside cartridge 108. For example, in some alternative embodiments, cleaning module 106 may be located proximate to an outer wall of cartridge 108 and/or may be a separable but related component of the overall system. Cartridge 108 generally refers to any suitable housing operable to contain the components of CAD 100. In some embodiments, cartridge 108 may be in 1-pound, 4-pound, 5-pound, and 8-pound sizes, which in some cases may be suitable for hand-loading and muzzle-loading purposes; however, the size of cartridge 108 may have any suitable size depending on the application.

The operation of particular embodiments of the present disclosure may be explained in the context of a bomb/missile rack used to secure one or more bombs/missiles to a military aircraft. In some such embodiments, CAD 100 may be a component of a stores release system. In operation, a pilot or bombardier triggers a signal that causes the release system to shove the bomb(s)/missile(s) away from the aircraft. In a particular embodiment, for example, initiator 102 may trigger energetic material 104, thereby effecting a precise explosion that is mechanically harnessed to open hooks that are holding the bomb(s)/missile(s) and/or to power pistons that shove the bomb(s)/missile(s) away from the aircraft.

The explosions of energetic material 104 may also generate any of a variety of undesirable byproducts or effects. For example, the explosion may raise pressure and temperature very quickly, which may generate pressure spikes that negatively affect the mechanics and reliability of the system. In addition, the explosions may leave behind residue that can cause corrosion that generates friction or otherwise inhibits subsequent use of the system. Some conventional bomb racks are dismantled after every one or two firings in order to clean the carbon soot left behind by prior bomb releases, which may waste valuable time and resources during what may very well be a state of emergency in some cases.

Accordingly, the teachings of some embodiments of the present disclosure provide a self-cleaning CAD 100 that includes cleaning module 106. More specifically, the explosion of energetic material 104 may vaporize and spread the contents of cleaning module 106, thereby cleaning at least some of the residue left behind by the previous CAD 100 and perhaps even some of the residue generated by the current explosion. In addition, the release of the contents within cleaning module 106 may cool down the combustion and slow the pressure rise resulting from the explosion, thereby stretching and smoothing out the mechanical response while mitigating the risk of sudden pressure spikes. In some embodiments, the contents of cleaning module 106 may also be used for lubrication purposes. Thus, some of the advantages of the present disclosure apply to CADs and PADs that are expended in repeated operations, such as those used for stores release, in addition to CADs and PADs that are typically used only in emergencies, such as aviator ejection systems.

Although guns and explosive destruct devices are generally not regarded as CAD or PAD systems, guns and explosive destruct devices might similarly benefit from some of the teachings of the present disclosure. One example embodiment of a gun cleaning cartridge is described with reference to FIG. 2.

FIG. 2 is a cross-section view of a portion of a gun cleaning cartridge 200 according to a particular embodiment. The illustrated cartridge 200 generally includes a mechanical snap-action switch 202, power source 204, initiator 206, energetic material 208, and cleaning module 210. In this example, cartridge 200 is designed as a specialized "blank" cartridge that may be configured to fit into the barrel of a firearm (e.g., a pistol, rifle, etc.) and capable of cleaning the gun barrel in response to the firing mechanism of the gun.

Mechanical snap-action switch 202 generally refers to any switch capable of mechanically closing contacts of an electrical circuit in response to an applied pressure exceeding a particular threshold. For example, switch 202 may be configured to respond to the hammer action of a firearm by mechanically closing a circuit that effects the release of energy stored in power source 204. In various embodiments, switch 202 may comprise a contact area that forms a portion of one of the faces of cartridge 200. For example, a contact area of switch 202 may be located near the center of the case head of cartridge 200 for use with firearms that shoot center-fire ammunition or switch 202 may alternatively be located near the rim of the case head for use with firearms that shoot rim-fire ammunition.

Power source 204 generally refers to any electrical circuit component capable of providing electrical energy. For example, power source 204 may be a high voltage capacitor capable of discharging voltages within the range of 1,000 to 10,000 volts; however, any suitable power source 204 capable of producing any suitable level of electrical energy may be used.

Initiator 206 generally refers to any component capable of initiating the explosion of energetic material 208. For example, initiator 206 may be an exploding foil initiator (EFI) comprising one or more foils; however, any suitable initiator 206 comprising any of a variety of subcomponents may be used.

Energetic material 208 generally refers to any suitable material(s) capable of releasing explosive energy or propellant energy. In various embodiments, energetic material 208 may comprise a secondary explosive that may be relatively insensitive to shock, friction, and/or heat. For example, Energetic material 208 may include red dot powder, black powder, smokeless powder, hexanitrostilbene (HNS), bistetrazolylaminotetrazine (BTATz), high Nitrogen energetics, a combustible plastic, gel or liquid, any suitable combination of the preceding, or any other suitable material capable of releasing explosive or propellant energy.

Cleaning module 210 generally refers to any material(s) that may be used to clean a portion of a gun. For example, cleaning module 210 may include water, detergent, light oil, padding or wadding, any combination of the proceeding, or any other material capable of cleaning a portion of a gun. In the illustrated example, cleaning module 210 includes one or more cleaning agent(s) 210*a* in the form of a solid, liquid, and/or gel, which cleaning agent(s) 210*a* are at least partially separated from wadding 210*b* within cartridge 200; however, all or a portion of cleaning agent(s) 210*a* and wadding 210*b* may alternatively be combined at a particular location within cartridge 200.

In operation, cartridge 200 may be loaded into a firearm in a manner substantially similar to the manner ammunition is typically loaded. Taking proper safety precautions, a user may squeeze the trigger of the firearm to implement the cleaning function of cartridge 200. More specifically, in a particular embodiment, the hammer action of the firearm may initiate the snap-action of switch 202, which mechanically closes a circuit that enables the transfer of electrical energy from power source 204 to initiator 206. The transferred energy may cause a thin metallic foil of initiator 206 to explode or vaporize and may rapidly accelerate another foil or flyer plate into contact with energetic material 208, thereby causing energetic material 208 to explode. The heat and/or pressure generated by the explosion of energetic material may vaporize and/or spread the components of cleaning module 210 along the length of the barrel of the firearm, thereby providing a cleaning mechanism for the firearm.

Thus, various embodiments of cartridge 200 may initiate the explosion of energetic material 208 electro-mechanically without the use of a primary explosive substance and thus may not necessarily include hazardous materials commonly used in primary explosives, such as, for example, mercury fulminate, lead styphnate, lead azide etc. Such electro-mechanical initiating mechanisms may not only be safer than the primary/secondary explosive combination of conventional ammunition, but may also provide a cleaner and more condensed initiating mechanism, thereby optimizing the cleaning efficiency and design flexibility of cartridge 200.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A mechanical actuation device comprising:

energetic material coupled to an initiator, the energetic material operable to generate an explosion that drives a piston and generates one or more byproducts, the initiator capable of initiating the explosion of the energetic material; and a cleaning module in proximity to the energetic material and containing cleanser, the cleaning module capable of releasing, in response to the explosion of the energetic material, the cleanser in a manner that affects the one or more byproducts generated by the explosion of the energetic material;

wherein the energetic material and the cleaning module form respective portions of a cartridge; and wherein the piston is external to the cartridge and capable of harnessing the explosion to perform a mechanical work function.

2. The mechanical actuation device of claim 1, wherein the cleaning module is further capable of lubricating one or more mechanical contact points of the mechanical actuation system by the released cleanser of the cleaning module.

3. The mechanical actuation device of claim 1, wherein the cleaning module is further capable of vaporizing and spreading at least a portion of the released cleanser in a manner that affects the one or more byproducts generated by the explosion of the energetic material.

4. The mechanical actuation device of claim 1, wherein the cleaning module is further capable of releasing the cleanser in a manner that cleanses one or more second byproducts generated by another explosion, the one or more second byproducts existing when the energetic material explodes.

5. The mechanical actuation device of claim 1, wherein the one or more byproducts comprise carbon soot and respective changes in heat and pressure.

6. The mechanical actuation device of claim 1, wherein the cleanser of the cleaning module comprises one or more components selected from the group consisting of:

water;
detergent;
light oil;
padding; and
wadding.

7. The mechanical actuation device of claim 1, wherein the cleanser of the cleaning module comprises one or more physical forms selected from the group consisting of:

solid;
liquid; and
gel.

8. The mechanical actuation device of claim 1, wherein the energetic material comprises one or more components selected from the group consisting of:

red dot powder;
black powder;
smokeless powder;
hexanitrostilbene (HNS);
bistetrazolylaminotetrazine (BTATz);
high Nitrogen energetics;
combustible plastic;
combustible gel; and
combustible liquid.

9. A mechanical actuation device comprising:

a cartridge comprising:

energetic material that generates an explosion when initiated, the energetic material enclosed within the cartridge, the explosion of the energetic material generating a force that triggers a release of a locking system external to the cartridge; and a cleaning module enclosed within the cartridge such that the force generated by the explosion of the energetic material further triggers release of cleanser from the cleaning module.

10. The mechanical actuation device of claim 9, wherein the release of cleanser from the cleaning module at least partially slows the force that triggers the release of the locking system external to the cartridge.

11. The mechanical actuation device of claim 9, wherein the locking system releasably couples a component to a vehicle.

12. The mechanical actuation device of claim 11, wherein the component coupled to the vehicle is selected from the group consisting of:

a missile;
a bomb; and
a canopy.

* * * * *